US010871290B2

(12) United States Patent
Wie et al.

(10) Patent No.: US 10,871,290 B2
(45) **Date of Patent: *Dec. 22, 2020**

(54) GAS COOKER

(71) Applicant: LG ELECTRONICS INC., Seoul (KR)

(72) Inventors: Jeahyuk Wie, Seoul (KR); Daebong Yang, Seoul (KR); Youngsoo Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 51 days.

This patent is subject to a terminal disclaimer.

(21) Appl. No.: 16/267,821

(22) Filed: Feb. 5, 2019

(65) Prior Publication Data

US 2019/0170366 A1 Jun. 6, 2019

Related U.S. Application Data

(62) Division of application No. 15/255,495, filed on Sep. 2, 2016, now Pat. No. 10,240,799.

(30) Foreign Application Priority Data

Sep. 3, 2015 (KR) ..... 10-2015-0125177

(51) Int. Cl.
*F24C 3/00* (2006.01)
*F24C 15/10* (2006.01)
(Continued)

(52) U.S. Cl.
CPC ..... *F24C 15/101* (2013.01); *F23D 14/14* (2013.01); *F23D 14/70* (2013.01); *F23D 14/78* (2013.01);
(Continued)

(58) Field of Classification Search
CPC .... F24C 15/101; F24C 15/001; F24C 15/108; F24C 3/08; F24C 3/103
(Continued)

(56) References Cited

U.S. PATENT DOCUMENTS 5,509,403 A * 4/1996 Kahlke ..... F24C 3/067 126/39 E
10,240,799 B2 * 3/2019 Wie ..... F24C 3/08
(Continued)

FOREIGN PATENT DOCUMENTS

JP 2004-069113 3/2004
JP 2004-251589 9/2004
(Continued)

OTHER PUBLICATIONS

International Search Report in International Application No. PCT /KR2016/0097 41, dated Dec. 28, 2016, 3 pages (with English translation).
Extended European Search Report in European Application No. 16842295.4, dated May 20, 2019, 8 pages.

*Primary Examiner* — Vivek K Shirsat
(74) *Attorney, Agent, or Firm* — Fish & Richardson P.C.

(57) ABSTRACT

A gas cooker that includes a case defining an interior area, the case including an opening to the interior area; a plate covering, fully or in part, the opening of the case; a burner that is located in the interior area of the case, wherein the burner includes a heating element that is heated using gas; a vent that is located at a first position of the case and that is configured to discharge burned gas from the interior area of the case to an exterior of the case; an insulating case that is coupled to the burner and that is configured to hold the burner; and a first insulator that is coupled between the insulating case and the plate and that is configured to seal an interior space of the burner is disclosed.

20 Claims, 13 Drawing Sheets

(51) Int. Cl.

| | |
|---|---|
| ***F24C 15/00*** | (2006.01) |
| ***F24C 3/04*** | (2006.01) |
| ***F23D 14/14*** | (2006.01) |
| ***F23D 14/70*** | (2006.01) |
| ***F23D 14/78*** | (2006.01) |
| ***F24C 3/08*** | (2006.01) |
| ***F24C 3/10*** | (2006.01) |

(52) U.S. Cl.
CPC ..... *F24C 3/047* (2013.01); *F24C 3/08* (2013.01); *F24C 3/103* (2013.01); *F24C 15/001* (2013.01); *F24C 15/108* (2013.01)

(58) Field of Classification Search
USPC ..... 126/39 K, 29 H, 39 N, 39 J, 39 R
See application file for complete search history.

(56) References Cited

U.S. PATENT DOCUMENTS

| | | | | |
|---|---|---|---|---|
| 2008/0149092 | A1 | 6/2008 | Lee et al. | |
| 2009/0173333 | A1* | 7/2009 | Kwon ..... | F24C 3/067<br>126/39 E |

FOREIGN PATENT DOCUMENTS

| | | |
|---|---|---|
| KR | 10-2002-0056248 | 7/2002 |
| KR | 10-0741799 | 7/2007 |
| KR | 10-0809746 | 3/2008 |

* cited by examiner

GAS COOKER

CROSS-REFERENCE TO RELATED APPLICATION

The application is a divisional of U.S. application Ser. No. 15/255,495, filed on Sep. 2, 2016, which claims priority under 35 U.S.C. § 119 and 35 U.S.C. § 365 to Korean Patent Application No. 10-2015-0125177, filed on Sep. 3, 2015. The disclosures of the prior applications are incorporated by reference in their entirety.

TECHNICAL FIELD

The present disclosure generally relates to a gas cooker.

BACKGROUND

A gas cooker is a home appliance that cooks food using heat. The gas cooker provides heat using gas.

The gas cooker is classified into an open-flame type in which a burner is exposed to an outside of a product, and flame directly heats food or heats a container in which the food is put, and a radiant type in which the burner is provided inside the product, and a radiator is heated using combustion heat, and the food or the container in which the food is put is heated using a radiant wave emitted from the heated radiator to an outside.

SUMMARY

The present disclosure is related to a gas cooker that has an insulating member for preventing heat from being transferred when a burner operates. In addition, the insulating member of the gas cooker prevents a case of the gas cooker from being overheated by combustion heat.

In general, one innovative aspect of the subject matter described in this specification can be embodied in a gas cooker comprising: a case defining an interior area, the case including an opening to the interior area; a plate covering, fully or in part, the opening of the case; a burner that is located in the interior area of the case, wherein the burner includes a heating element that is heated using gas; a vent that is located at a first position of the case and that is configured to discharge burned gas from the interior area of the case to an exterior of the case; an insulating case that is coupled to the burner and that is configured to hold the burner; and a first insulator that is coupled between the insulating case and the plate and that is configured to seal an interior space of the burner.

The foregoing and other embodiments can each optionally include one or more of the following features, alone or in combination. In particular, one embodiment includes all the following features in combination. A first end of the first insulator extends to the vent. The first insulator is coupled between the burner and the insulating case. The gas cooker includes a plurality of burners located in the interior area of the case, wherein the first insulator covers areas between the plurality of burners. The first insulator comprises a sheet that is coupled to a circumferential portion of each burner. The first insulator includes: a border portion coupled to a circumferential portion of the insulating case; and a partitioning portion that extends from a first area of the border portion to the vent, wherein the partitioning portion, in part or fully, covers areas between the plurality of burners. The partitioning portion includes one or more branches and is coupled to a circumferential portion of each burner. A second insulator that is coupled between the burner and the insulating case and that is configured to reduce heat transfer from the interior space of the burner to the insulating case. The insulating case includes a burner hole that holds the burner, and wherein the second insulator includes an open area corresponding to the burner hole and covers a surrounding area of the burner hole of the insulating case. A border line of the open area substantially matches to a border line of the burner hole. The burner includes: a burner port configured to provide gas and hold the heating element, a spark plug configured to ignite fire using the provided gas, wherein the heating element is heated by the ignited fire; a burner holder that (i) is configured to hold the spark plug, (ii) is coupled between the burner port and the plate, and (iii) includes a burned gas guide portion that flows burned gas to the vent; and a burner cover that is configured to cover the burned gas guide portion of the burner holder and that is configured to flow burned gas to the vent. The second insulator is coupled to the burned gas guide portion. The gas cooker includes a plurality of burners located inside the insulating case, wherein the second insulator is coupled to each of the plurality of burners and configured to reduce heat transfer from each of the plurality of burners to the insulating case. The first insulator and the second insulator comprise compressible insulating material. The gas cooker includes: a plate bracket that is coupled to the plate and that is configured to hold the first insulator to prevent the first insulator from contacting the case. The first insulator or the second insulator comprises elastically deformable material that is configured to be compressed. The gas cooker includes a fan configured to provide air flow to the vent. The fan is configured to provide air flow to the insulating case. The plate is a metal plate. The plate is a ceramic plate.

The details of one or more examples of the subject matter described in this specification are set forth in the accompanying drawings and the description below. Other potential features, aspects, and advantages of the subject matter will become apparent from the description, the drawings, and the claim.

BRIEF DESCRIPTION OF THE DRAWINGS

Like reference numbers and designations in the various drawings indicate like elements.

DETAILED DESCRIPTION

Figure 1:
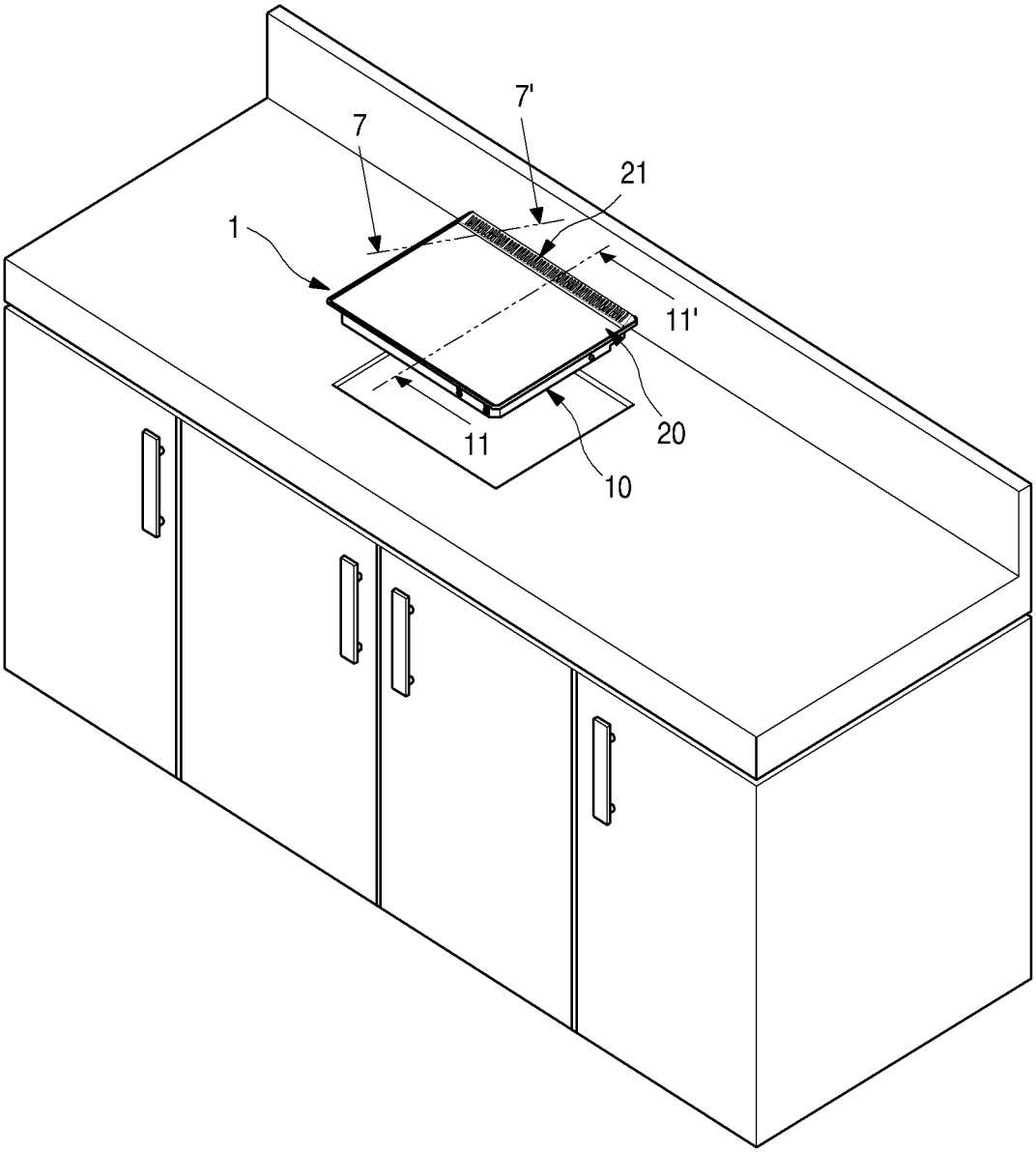
FIG. 1 is a diagram illustrating an example gas cooker.

FIG. 1 illustrates an example gas cooker. A gas cooker 1 may be installed at an upper surface of furniture such as a sink. The gas cooker 1 is formed to be seated in an opening formed at an upper surface of the sink, and an exterior thereof exposed through the upper surface of the sink may be formed by a plate 20.

And the entire exterior of the gas cooker 1 may be generally configured with a case 10, the plate 20 and a vent 21.

The case 10 may be formed of a plate-shaped steel material, and an upper surface thereof is bent to be opened, and thus a space in which a plurality of elements for operating the gas cooker 1 are accommodated is provided therein. And when the gas cooker 1 is installed at the sink, the case 10 is in an accommodated state inside the opening of the sink.

The plate 20 forming an upper surface of the gas cooker 1 is provided at the opened upper surface of the case 10. The plate 20 shields the opening of the sink while the gas cooker 1 is installed at the sink, is exposed through the upper surface, and forms the exterior of the upper surface of the gas cooker 1. And the plate 20 provides a flat surface on which food to be cooked is seated.

And the vent 21 through which exhaust gas is discharged is provided at a rear end of the plate 20. The vent 21 is formed to slightly protrude from the plate 20, and a plurality of vent holes 211 are opened at the vent 21 so that the exhaust gas is discharged through the vent holes 211.

Figure 2:
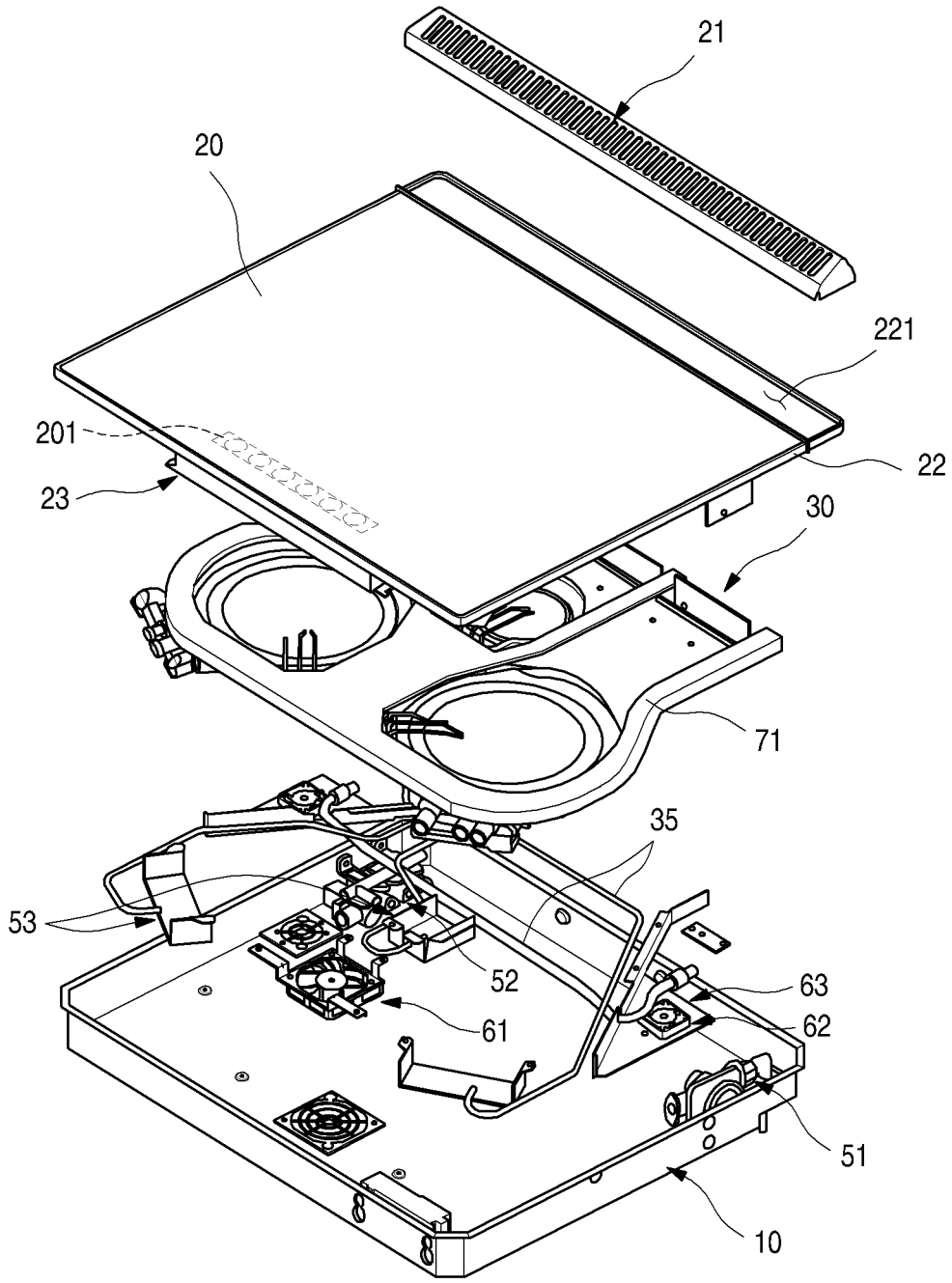
FIG. 2 is a diagram illustrating an inside area of an example gas cooker.
Figure 3:
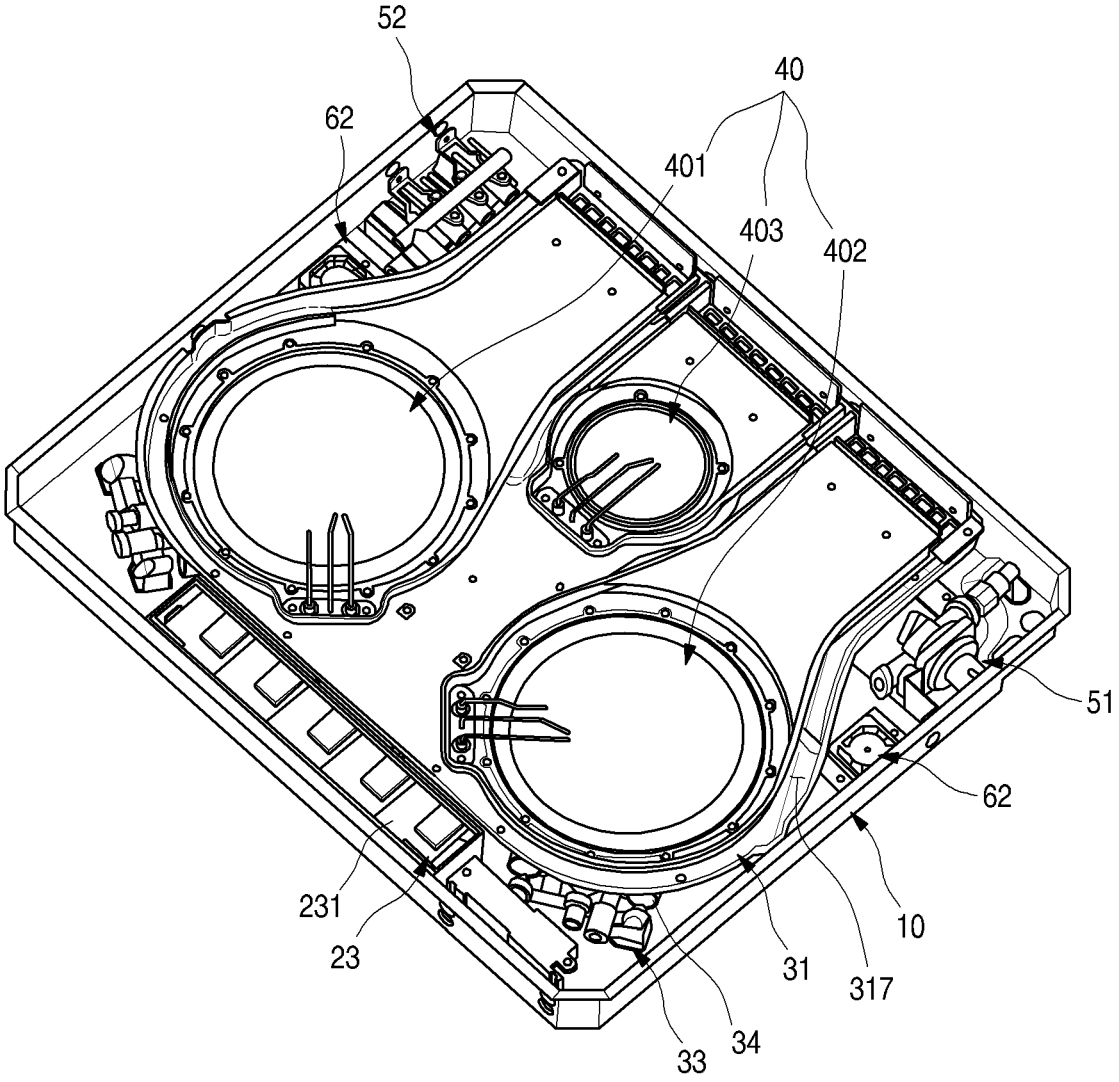
FIG. 3 is a diagram illustrating an inside area of an example gas cooker.
Figure 4:
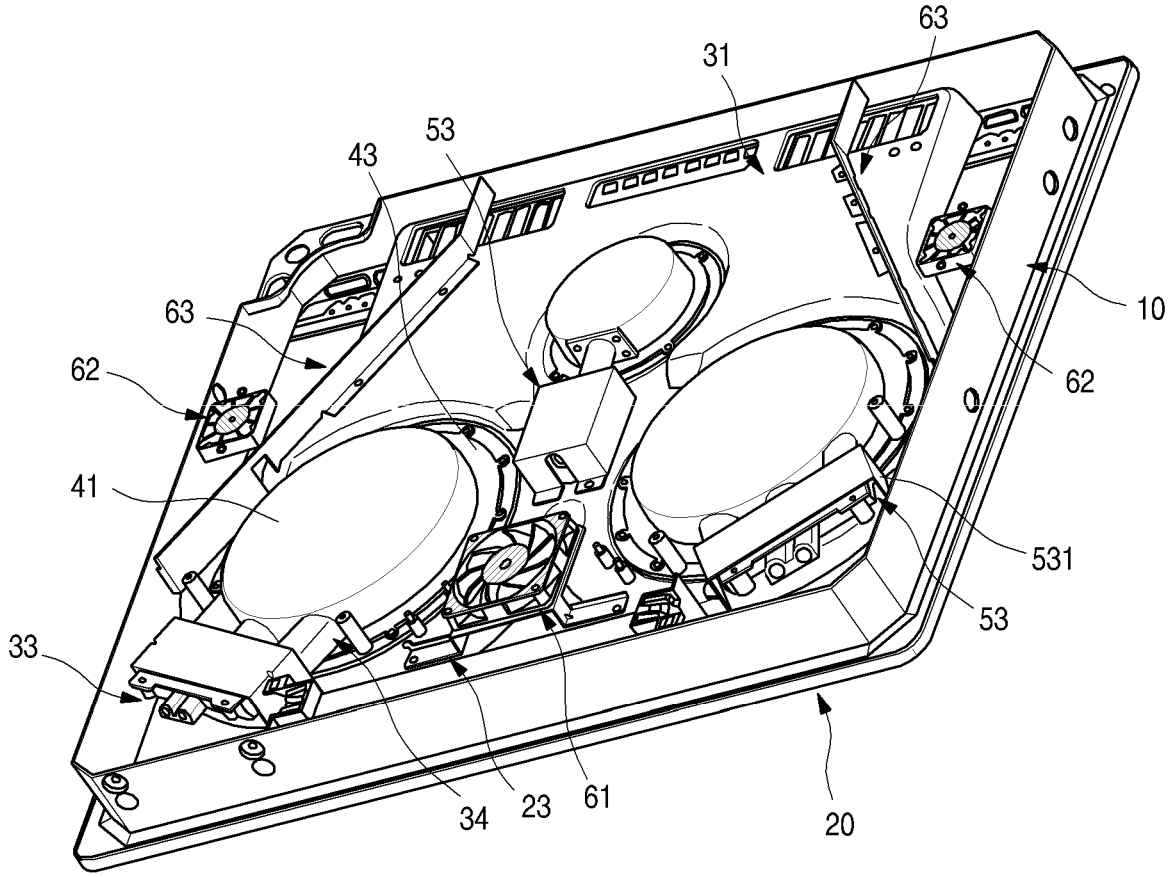
FIG. 4 is a diagram illustrating an inside area of an example gas cooker.

FIGS. 2-4 illustrate an inside area of an example gas cooker.

A configuration of the gas cooker will be described in detail with reference to the drawings. The upper surface of the gas cooker 1 is formed by the plate 20, and the other exterior except the upper surface is formed by the case 10.

The plate 20 may be formed of a ceramic glass material, and a top frame 22 may be provided at a perimeter of the plate 20, and may form an exterior of the perimeter of the plate 20. And a vent seating portion 221 which is opened so that the vent 21 is seated therein may be further formed at the top frame 22.

An operation unit 23 may be provided under the plate 20. The operation unit 23 is operated to control heating power of the gas cooker 1 by a user, and may be formed to be operated by the user's touching operation. Of course the operation unit 23 may be configured with an electronic switch or a sensor, instead of a touching method.

An operation part 201 which enables the user to recognize an operating portion of the operation unit 23 may be formed at an upper surface of the plate 20 corresponding to the operation unit 23. The operation part 201 may be formed at the upper surface of the plate 20 in a printing method or a film attaching method, and may also be formed in a transparent or translucent type so that at least a part of the operation unit 23 is exposed. Also, the operation part 201 may be formed not to be recognized from an outside through the plate 20 before an operation thereof, but to be recognized from the outside by turning on a separate backlight.

The operation unit 23 may be located at a front end of the plate 20, and may be formed so that an upper end of the operation unit 23 is in completely close contact with the plate 20. And the operation unit 23 may also be formed to be coupled to the plate 20 and thus to be disassembled from or assembled to the case 10 in a module state.

In some implementations, the opened upper surface of the case 10 may be formed to have a somewhat smaller area than that of the plate 20, and may also be formed to have a structure in which the perimeter of the plate 20 further protrudes to an outside of the case 10 when being coupled to the plate 20. And an exterior of the case 10 may be formed by bending the steel plate material, and if necessary, may be formed by injection-molding a resin material.

When the plate 20 and the case 10 are coupled to each other, a space is formed inside the case 10, and a burner unit 30 may be provided in the space. The burner unit 30 may include a plurality of burners 40 in which combustion of a supplied mixed gas occurs, and an insulating case 31 at which the burners 40 are fixed and installed.

Each of the burners 40 has a nozzle 33 for supplying the gas, and a mixing tube 34 through which a gas and air are mixed and introduced to a burner port 41 may be provided at an outlet side of the nozzle 33. The nozzle 33 and the mixing tube 34 may be formed in one module, and may be respectively fixed to and installed at the burner port 41.

In some implementations, the plurality of burners 40 may be provided, and may include a first burner 401 and a second burner 402 which are provided at both of left and right sides inside the case 10, and a third burner 403 which is provided between the first burner 401 and the second burner 402 provided at both of the left and right sides and has a size smaller than each of the first burner 401 and the second burner 402.

And all of the first burner 401, the second burner 402 and the third burner 403 may be seated on the insulating case 31, and may be installed inside the case 10. The number of burners 40 and a size of each of the burners 40, which are installed at the insulating case 31, are not limited to this example, and can be changed.

And the burner unit 30 may further include an insulating member. The insulating member may include an upper insulator 71 disposed between the plate 20 and the burner 40, and a lower insulator 72 disposed between the insulating case 31 and the burner 40.

The upper insulator 71 may be accommodated inside the insulating case 31, and may be disposed along a circumference of each of the plurality of burners 40. And an upper surface of the upper insulator 71 may be formed to be in close contact with a lower surface of the plate 20, to press the upper insulator 71 when the plate 20 and the burner unit 30 are assembled, and to be in completely close contact with the plate 20. At this point, a space above the plurality of burners 40 is independently partitioned by the upper insulator 71, and thus a burned gas is prevented from being introduced to the adjacent burners 40. The insulating member will be described below in detail.

In some implementations, a gas pipe 35 is provided inside the case 10. The gas pipe 35 is formed to connect a regulator 51 and a valve unit 52 with the burners 40, and thus to supply a gas to each of the burners 40. And a main fan 61 and a sub-fan 62 may be provided inside the case 10 to suction external air into the case 10 and to cool an inside of the case 10.

Figure 5:
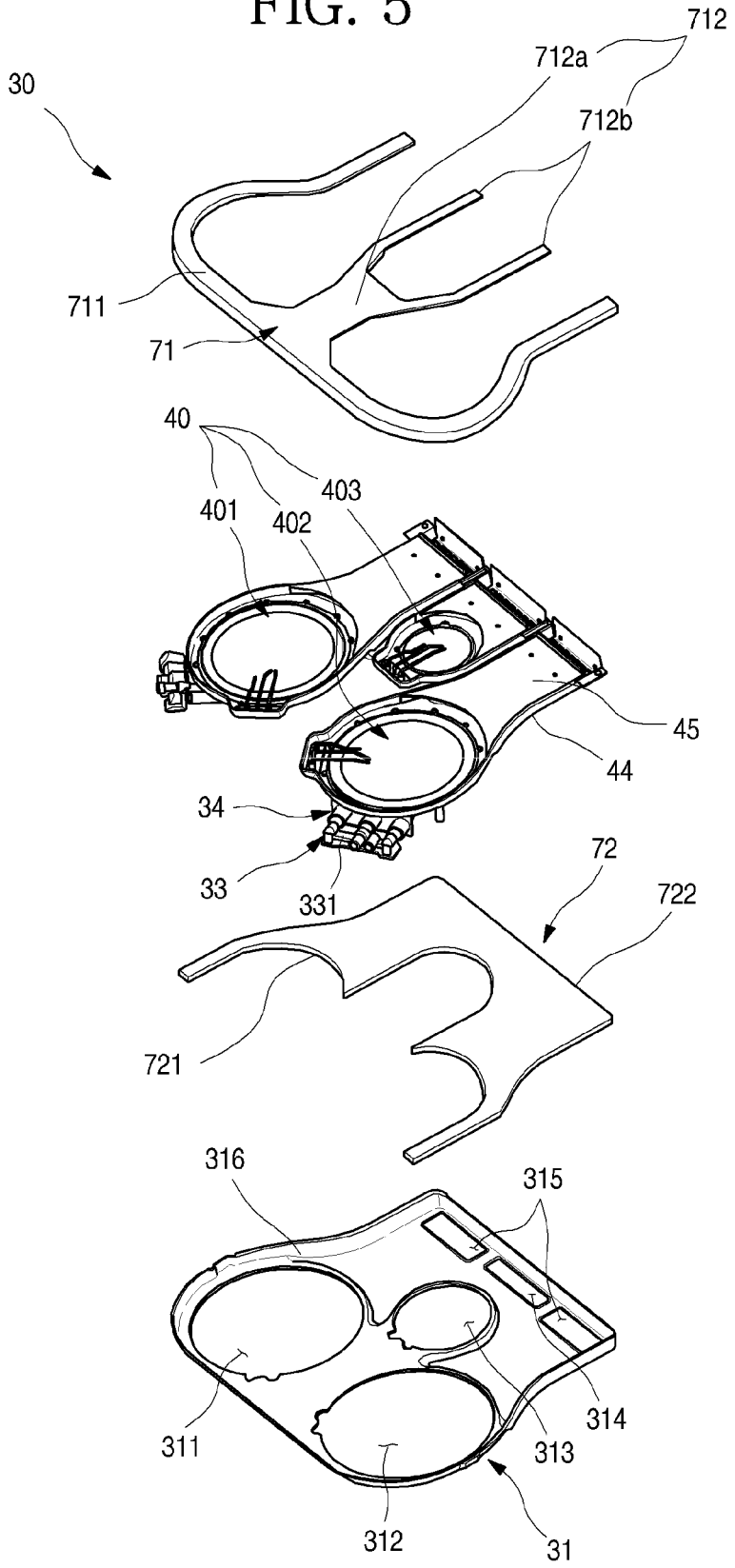
FIG. 5 is a diagram illustrating an example burner unit.
Figure 6:
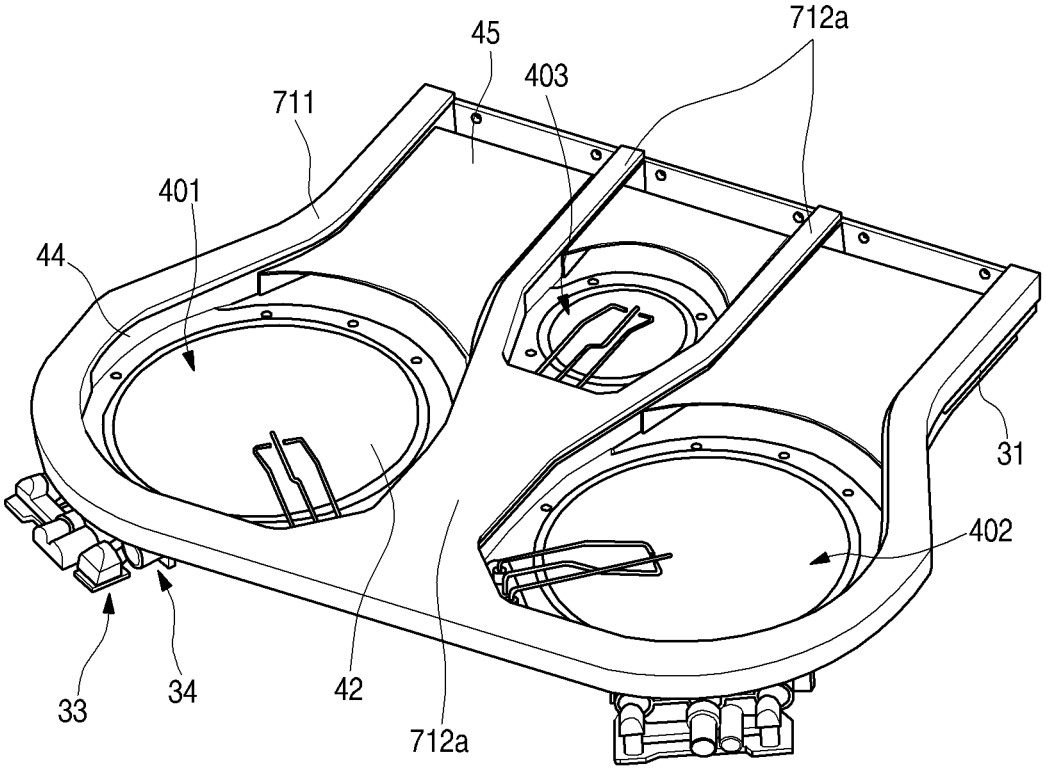
FIG. 6 is a diagram illustrating an example burner unit and an example insulating member.
Figure 7:
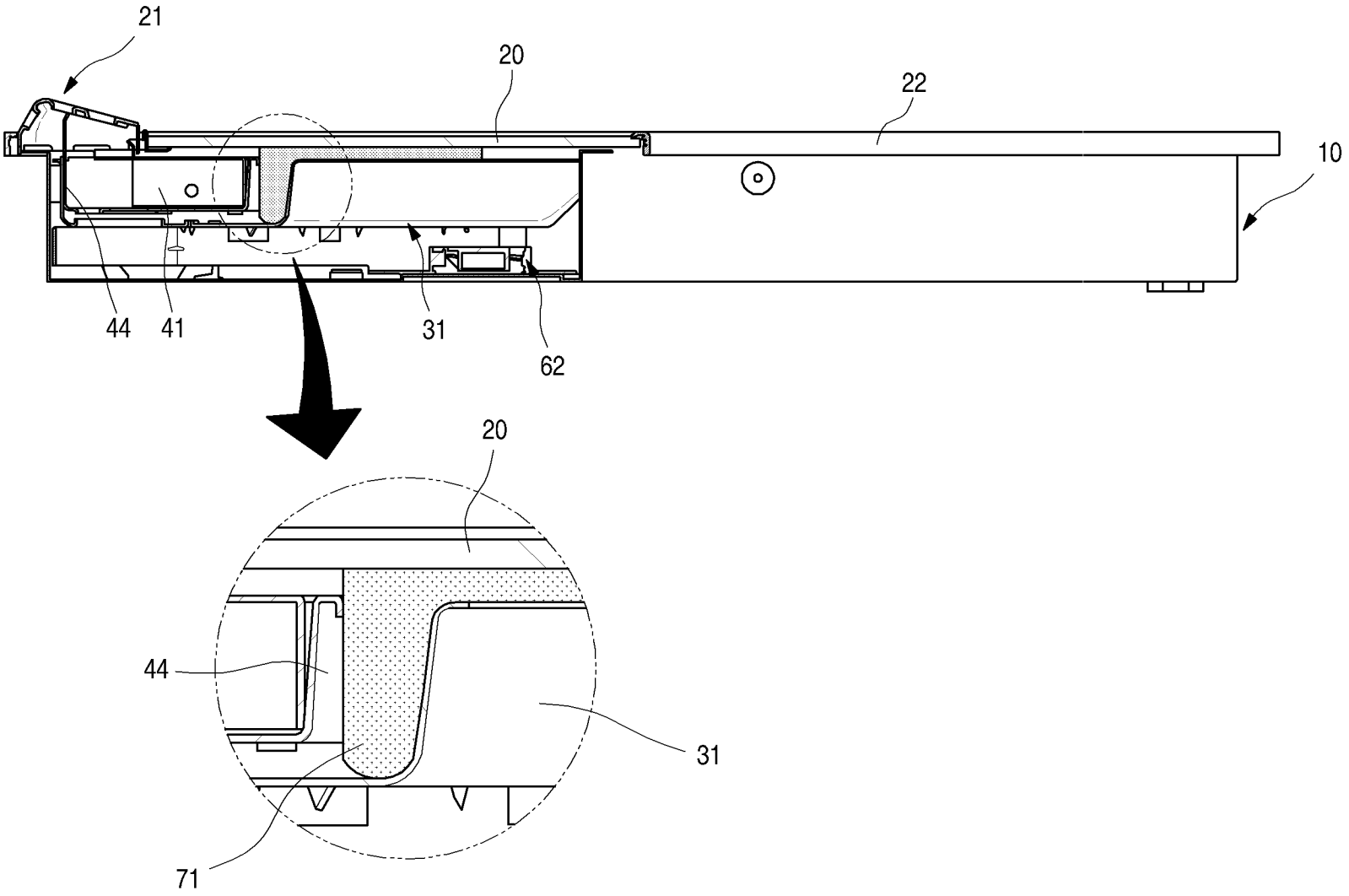
FIG. 7 is a diagram illustrating an example cross-sectional view of the example gas cooker of FIG. 1.

FIG. 5 illustrates an example burner unit. FIG. 6 illustrates an example burner unit and an example insulating member. FIG. 7 illustrates is an example cross-sectional view of the example gas cooker of FIG. 1.

The burner unit 30 may include the plurality of burners 40, and the insulating case 31 at which the plurality of burners 40 are seated. The burners 40 may include the first burner 401 and the second burner 402 which are provided at both of the left and right sides, and the third burner 403 which is provided between the first burner 401 and the second burner 402. At this point, the third burner 403 may be located at a rear side slightly further than the second burner 402, and may have a size smaller than the first burner 401 and the second burner 402.

The insulating case 31 has a shape of which an upper surface is opened to accommodate the burners 40, and the insulating case 31 may have a structure in which an upper end thereof is in contact with the plate 20 or the upper surface thereof is shielded by the plate 20.

And a first burner hole 311, a second burner hole 312 and a third burner hole 313 at which the first burner 401, the second burner 402 and the third burner 403 are respectively located are formed at the insulating case 31 so as to be opened.

And an exhaust port through which exhaust gas generated by the combustion and internal air of the case 10 are discharged is formed at a rear end of the insulating case 31. The exhaust port may include a central exhaust port 314 formed at a center, and side exhaust ports 315 formed at both sides of the central exhaust port 314.

The central exhaust port 314 may be formed to be slightly narrower than an area of each of the side exhaust ports 315. This is to reduce an amount of high-temperature exhaust gas discharged through the central exhaust port 314 and thus to reduce a temperature of the entire exhaust gas because a distance between the central exhaust port 314 and the third burner 403 is relatively shorter than a distance between the first and second burners 401 and 402 and the side exhaust ports 315.

That is, an amount of exhaust gas discharged through the side exhaust ports 315 having a relatively low temperature may be enabled to be greater than that of exhaust gas discharged through the central exhaust port 314, and thus the temperature of the entire exhaust gas which is mixed and discharged may be reduced.

In some implementations, the insulating case 31 has a border 316 which is bent upward along a perimeter of the insulating case 31, and a space for accommodating the burners 40 is formed therein. The insulating case 31 is formed to have a size which accommodates all of the plurality of burners 40. The insulating case 31 is formed in a module type, and separable from the case 10 or the plate 20.

And the border 316 of the insulating case 31 is spaced apart from an outer side of each of the burners 40 while the burners 40 are accommodated therein, and forms a predetermined space. An insulator accommodating space 317 in which the upper insulator 71 is inserted may be formed between the border 316 and the outer side of each of the burners 40.

While the upper insulator 71 is installed inside the insulating case 31, the plate 20 comes in close contact with and presses the upper insulator 71 when the burner unit 30 is installed, and may shield the opened upper surface of the insulating case 31 and the plurality of burners 40 from an upper side thereof.

The upper insulator 71 may be formed of an elastically deformable material, and may also be formed of a ceramic insulator. Therefore, at least a part of a lower portion of the upper insulator 71 may be press-fitted to the insulator accommodating space 317 formed between the border 316 of the insulating case 31 and an outer surface of each of the burners 40. And even when the upper insulator 71 is pressed by the plate 20, the upper insulator 71 may completely seal the space above each of the burners 40 due to an elastic deformation thereof, and thus may prevent the burned gas from being introduced to the adjacent burner 40.

In some implementations, a shape of the upper insulator 71 may be changed according to the number and an arrangement of the burners. In some implementations, three burners 40 are provided.

The upper insulator 71 may include a border portion 711 which is formed along the border 316 of the insulating case 31, and a partitioning portion 712 which extends along between the first burner 401 and the second burner 402 from a center of the border portion 711.

Specifically, the border portion 711 may be formed along the rear end of the insulating case 31, i.e., the border 316 except an end thereof at which the vent 21 is formed. That is, the border portion 711 may be formed to be accommodated inside the case 31 and to extend along the border 316.

And the border portion 711 may extend along a part of an outer surface of each of the first burner 401 and the second burner 402. That is, the border portion 711 may be formed to fill the insulator accommodating space 317 between the border 316 of the insulating case 31 and the outer surfaces of the first burner 401 and the second burner 402.

At this point, a width of the border portion 711 is formed to be the same as or slightly larger than a width of the insulator accommodating space 317, and formed to be press-fitted into the insulator accommodating space 317 while being elastically deformed. Also, a thickness of the border portion 711 is formed to be thicker than a height from a bottom of the insulating case 31 to the lower surface of the plate 20, and thus when the plate 20 is installed, the border portion 711 may be pressed while being elastically deformed.

The partitioning portion 712 may be formed to extend from a middle of the border portion 711 corresponding to between the first burner 401 and the second burner 402 toward the rear end of the insulating case 31. At this point, the partitioning portion 712 may extend along the outer surfaces of the first burner 401 and the second burner 402, and may fill a space between the first burner 401 and the second burner 402, and may be formed to extend while forming a branch portion **712*b* which is branched into both sides along the circumference of the third burner 403. The partitioning portion 712 may extend to the rear end of the insulating case 31, and may extend to the same location as a rear end of the border portion 711**.

A width of the partitioning portion 712 may be formed at a first half portion **712*a* thereof to correspond to or be slightly larger than the space between the first burner 401 and the second burner 402, and may be formed at the branch portion 712*b* to correspond to or be slightly larger than a space between the first burner 401 and the third burner 403 and between the second burner 402 and the third burner 403. And a thickness of the partitioning portion 712 may be formed to be the same as that of the border portion 711**.

In a state in which the upper insulator 71 is installed, both ends of the border portion 711 are located at outer ends of the side exhaust ports 315 of the insulating case 31, and both ends of the branch portion **712*b* of the partitioning portion 712 are located between the side exhaust ports 315 and the central exhaust port 314. That is, the side exhaust ports 315 and the central exhaust port 314 may be located at a space between the border portion 711 and the partitioning portion 712, and the exhaust gas may be discharged to the vent 21** in a state in which each of the exhaust ports is independently partitioned.

In some implementations, the lower insulator 72 may be provided at an inner side surface of the insulating case 31. The lower insulator 72 may be formed in one sheet, and may be formed to cover all of lower sides of the plurality of burners 40.

The lower insulator 72 may be formed of the same material as that of the upper insulator 71, and if necessary, may be formed of a separate material of which a thermal insulating property is more excellent than that of the upper insulator 71. And unlike the upper insulator 71, the lower insulator 72 may be formed of a material which is not elastically deformed.

And the lower insulator 72 is seated inside the insulating case 31 to cover a second half portion of the insulating case 31, i.e., the remaining bottom surface except the first burner hole 311, the second burner hole 312 and the third burner hole 313. The lower insulator 72 may be formed to cover an area including at least a portion corresponding to a burned gas guide portion 444 formed at each of the burners 40.

And the lower insulator 72 may include a burner side end 721 formed along a part of the circumference of each of the first burner 401, the second burner 402 and the third burner 403, and an insulator side end 722 formed from the burner side end 721 along the perimeter of the insulating case 31.

Therefore, the burned gas guide portion 444 through which the high-temperature burned gas generated from the first burner 401, the second burner 402 and the third burner 403 is discharged may be shielded by the lower insulator 72, and transferring of heat of the burned gas toward a lower side of the insulating case 31 may be minimized by shielding of the burned gas guide portion 444.

Hereinafter, a structure of each of the burners 40 will be described in detail. The burners 40 include the first burner 401, the second burner 402 and the third burner 403. However, each of the burners 40 is different only in the arrangement and a size thereof, and has the same basic structure. Therefore, hereinafter, a detailed structure of each of the burners 40 will be described based on the second burner 402. Since the first burner 401 and the second burner 402 have the same structure, detailed description thereof will be omitted.

Figure 8:
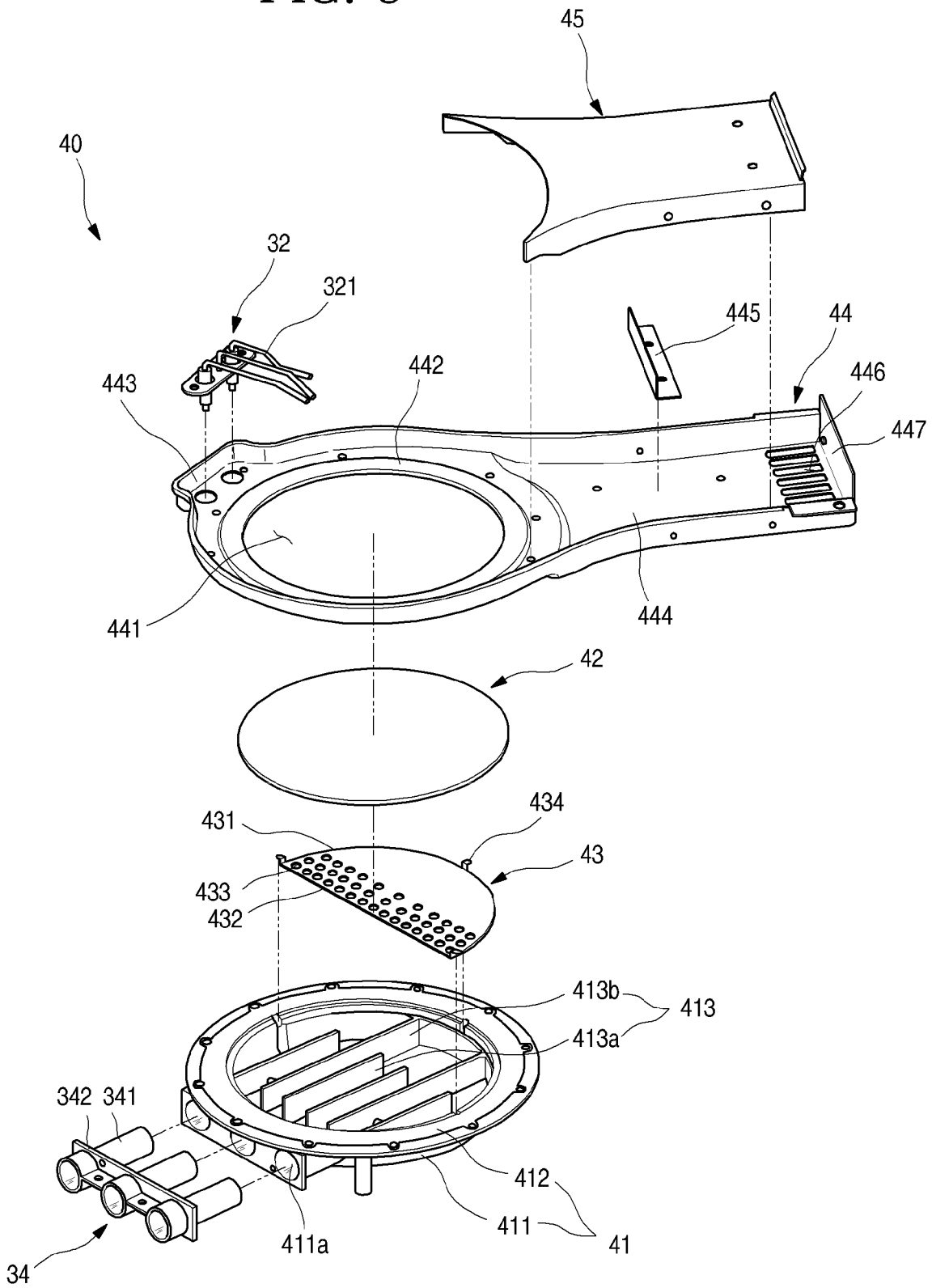
FIG. 8 is a diagram illustrating an example burner.

FIG. 8 illustrates an example burner.

As illustrated in the drawings, the burner 40 may include the burner port 41 to which the mixed gas is supplied, a heating element 42 which is seated at the burner port 41 to be heated by the combustion of the mixed gas, and a burner holder 44 and a burner cover 45 which support the burner port 41 and the heating element 42.

Specifically, the burner port 41 is formed in a circular shape which is opened upward. And the burner port 41 may include an accommodating portion 411 in which the mixed gas is accommodated, and a flange portion 412 which is bent outward from an end of the accommodating portion 411.

A tube insertion hole 411*a* in which the mixing tube 34 is inserted is opened at one side of an outer portion of the accommodating portion 411. The mixing tube 34 is inserted and installed into the burner port 41, and while the mixing tube 34 is installed, an inlet port of the mixing tube 34 protrudes to an outside of the accommodating portion 411, and an outlet port of the mixing tube 34 is located at a predetermined location inside the accommodating portion 411.

In some implementations, the mixing tube 34 may include a plurality of extension tubes 341 which are disposed to be spaced apart from each other, and a tube holder 342 which connects the extension tubes 341 and is fixed to and installed at the tube insertion hole 411*a*. Each of the extension tubes 341 extends from an outside of the burner port 41 toward an inside thereof, and outlet ports of the extension tubes 341 are located in the same depth inside the burner port 41.

The plurality of extension tubes 341 may be disposed at regular intervals so that the gas supplied through the nozzle 33 is evenly introduced into the burner port 41. In some implementations, three extension tubes 341 are provided, but two or more extension tubes 341 may be variously provided.

And a plurality of nozzles 33 through which the mixed gas is injected has a structure which is fixed by a nozzle holder 331, and an outlet port of each of the nozzles 33 is located at a location corresponding to an inlet port of each of the extension tubes 341.

That is, the inlet port of the mixing tube 34 is located at the location corresponding to the outlet port of the nozzle 33 to be spaced apart by a predetermined gap, such that air is mixed together by a pressure difference due to a flow of the gas when the gas is injected through the nozzle 33.

In some implementations, a plurality of distribution ribs 413 may be provided inside the accommodating portion 411. The distribution ribs 413 serve to enable the mixed gas introduced into the accommodating portion 411 to flow in one direction and then to flow again in an opposite direction, and extend upward from a bottom surface of the burner port 41. The distribution ribs 413 may be molded with the burner port 41, and may be integrally formed with the burner port 41.

At this point, each of the distribution ribs 413 is formed to have a height corresponding to a stepped plate seating portion 411*b* formed at an upper end of the accommodating portion 411. Therefore, while the heating element 42 is seated on the plate seating portion 411*b*, an upper end of each of the distribution ribs 413 is in contact with a lower end of the heating element 42, and the distribution ribs 413 form a flowing passage of the mixed gas.

And the distribution ribs 413 may include a first rib 413*a* which extends from an outlet port side of the mixing tube 34 so that an end thereof is spaced apart from a wall surface of the accommodating portion 411, and a second rib 413*b* which is disposed at a lateral side of the first rib 413*a* and extends from a wall surface facing the outlet port of the mixing tube 34 to the outlet port side of the mixing tube 34. The first rib 413*a* and the second rib 413*b* are disposed close to each other, and due to the first rib 413*a* and the second rib 413*b*, the mixed gas discharged from the mixing tube 34 flows in one direction and then flows again in the opposite direction.

In some implementations, an ignition rib 414 is formed at one side thereof, which is spaced apart from the outlet port of the mixing tube 34, to protrude upward. The ignition rib 414 may be formed to extend in a direction crossing a discharging direction of the mixed gas discharged from the outlet port of the mixing tube 34.

In some implementations, a distribution plate seating portion 411*c* at which a distribution plate 43 is installed is formed at a perimeter of an inner side surface of the accommodating portion 411. The distribution plate seating portion 411*c* is formed at an inner wall surface of the accommodating portion 411 facing the mixing tube 34, and formed to protrude to an inside of the accommodating portion 411, such that the distribution plate 43 is seated on an upper end thereof.

At this point, a length of the upper end of the distribution plate seating portion 411*c* may be formed to correspond to that of a curved portion 431 of the distribution plate 43. And a height of the distribution plate seating portion 411*c* is formed lower than that of the plate seating portion 411*b* so that an upper surface of the distribution plate 43 does not interfere with the heating element 42 while the distribution plate 43 is seated on the distribution plate seating portion 411*c*.

The distribution plate 43 is formed in a semi-circular plate shape to shield a part of an opened upper surface of the accommodating portion 411. The curved portion 431 of the distribution plate 43 is formed to have a curvature corresponding to an outer circumference of the accommodating portion 411. Therefore, the distribution plate 43 may be seated on the distribution plate seating portion 411*c*, and may shield the opened upper surface of the accommodating portion 411. And a straight portion 432 is located at a location facing the mixing tube 34. The straight portion 432 is located at a front side further than an end of the first rib 413*a*, i.e., a side of the mixing tube 34.

Therefore, the mixed gas introduced through the mixing tube 34 flows through the flowing passage, and then flows again via a lower side of the distribution plate 43 in the opposite direction. At this point, the distribution plate 43 may shield the supplied mixed gas from flowing through an upper side thereof.

And a plurality of distribution holes 433 may be formed at the distribution plate 43. The distribution holes 433 is formed from the straight portion 432 of the distribution plate 43 toward the curved portion 431 so that the number thereof is gradually reduced from the straight portion 432 toward the curved portion 431. That is, a portion of the mixed gas strongly discharged from the mixing tube 34 may come around in the direction opposite to the discharging direction by the distribution plate 43 and the distribution ribs 413, and another portion thereof may be supplied upward through the distribution holes 433.

In some implementations, an installation protrusion 434 protrudes from the curved portion 431 of the distribution plate 43, and an installation groove 411*d* matched with the installation protrusion 434 is formed at a corresponding portion of the distribution plate seating portion 411*c*. Therefore, the distribution plate 43 may be maintained in a stably installed state at the upper end of the accommodating portion 411.

The heating element 42 is seated on the plate seating portion 411*b* formed at the upper end of the accommodating portion 411. The heating element 42 is formed to completely shield the opened upper surface of the accommodating portion 411. The heating element 42 may be formed of a porous ceramic mat, and the mixed gas flowing upward at the accommodating portion 411 may be burned at the heating element 42. The heating element 42 may be formed of another material which is usable at the radiant burner 40.

The burner port 41 is seated at the burner holder 44. A burner hole 441 is opened at the burner holder 44, and the burner port 41 is inserted into the burner hole 441. At this point, a port seating portion 442 formed to be stepped is formed at a circumference of the burner hole 441, and the flange portion 412 of the burner port 41 is seated at the port seating portion 442. And a fastening member passing through the flange portion 412 may be fastened to the port seating portion 442, and thus the burner port 41 may be fixed to and installed at the burner holder 44.

And a plug installing portion 443 is formed at one side of the burner holder 44. The spark plug 32 is fixed to and installed at the plug installing portion 443. The spark plug 32 serves to ignite the mixed gas in the burner 40, is provided above the heating element 42, and extends from an outside of the heating element 42 toward an inside thereof to ignite the mixed gas.

Also, a flame detecting unit 321 may be provided at one side of the spark plug 32. The flame detecting unit 321 serves to check an ignition state of the burner 40 through a change in a voltage or a temperature of the heating element 42, and may be formed in a module integrally formed with the spark plug 32, and may extend along with the spark plug 32 from an upper side of the heating element 42 toward the inside of the heating element 42.

And the burned gas guide portion 444 formed to extend backward is formed at the burner holder 44. The burned gas guide portion 444 may extend to a rear end of the case 10 corresponding to a location of the vent 21. Therefore, the burned gas generated when the combustion occurs at the burner 40 may be guided to the vent 21 along the burner holder 44, and then may be discharged to an outside.

At this point, the burned gas guide portion 444 is spaced apart from a rear surface of the case 10, and a passage P through which the cooling air flows may be formed between a rear surface of the burned gas guide portion 444 and the rear surface of the case 10.

And a reheating member 445 extending in a direction crossing a flowing direction of the burned gas is provided on the burned gas guide portion 444. The reheating member 445 extends to cross the burned gas guide portion 444, and is formed to extend upward, such that a flow of the burned gas flowing along the burned gas guide portion 444 temporarily stays, and thus the burned gas temporarily stays above the heating element 42, and thermal efficiency is increased, and initial ignition is easily performed.

A plurality of cooling holes 446 are formed at a rear end of the burned gas guide portion 444. The cooling holes 446 are located at positions corresponding to the exhaust ports 314 and 315 so that the cooling air introduced through the exhaust ports 314 and 315 is mixed with the high-temperature burned gas discharged through the burned gas guide portion 444, and then discharged to the vent 21.

The burner cover 45 is provided above the burned gas guide portion 444. The burner cover 45 forms a flow path of the burned gas flowing through the burned gas guide portion 444, and shields an opened upper side of the burned gas guide portion 444. And a rear end of the burner cover 45 is formed to be spaced apart from the rear end of the burned gas guide portion 444, such that cooling air passed through the cooling holes 446 and the burned gas passing through the burned gas guide portion 444 are mixed and then discharged.

A holder wall 447 which is bent upward and extends is formed at a rear end of the burner holder 44, i.e., rear ends of the cooling holes 446. The holder wall 447 guides the air guided through the burned gas guide portion 444 to flow upward.

The holder wall 447 is disposed to be spaced apart from the rear end of the burner cover 45 such that the burned gas guided by the burned gas guide portion 444 is mixed with the cooling air introduced through the cooling holes 446, flows upward, and is discharged through the vent 21.

Figure 9:
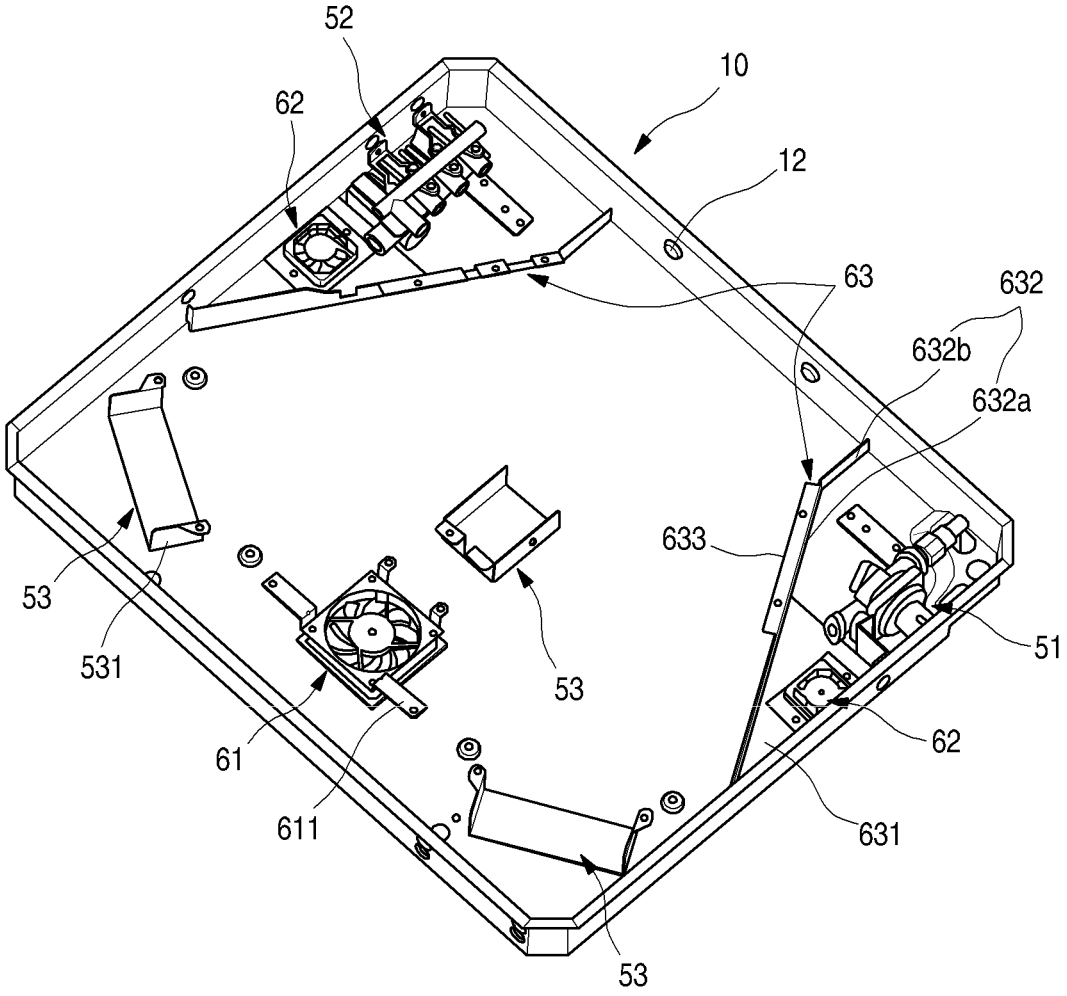
FIG. 9 is a diagram illustrating an inside area of an example case.
Figure 10:
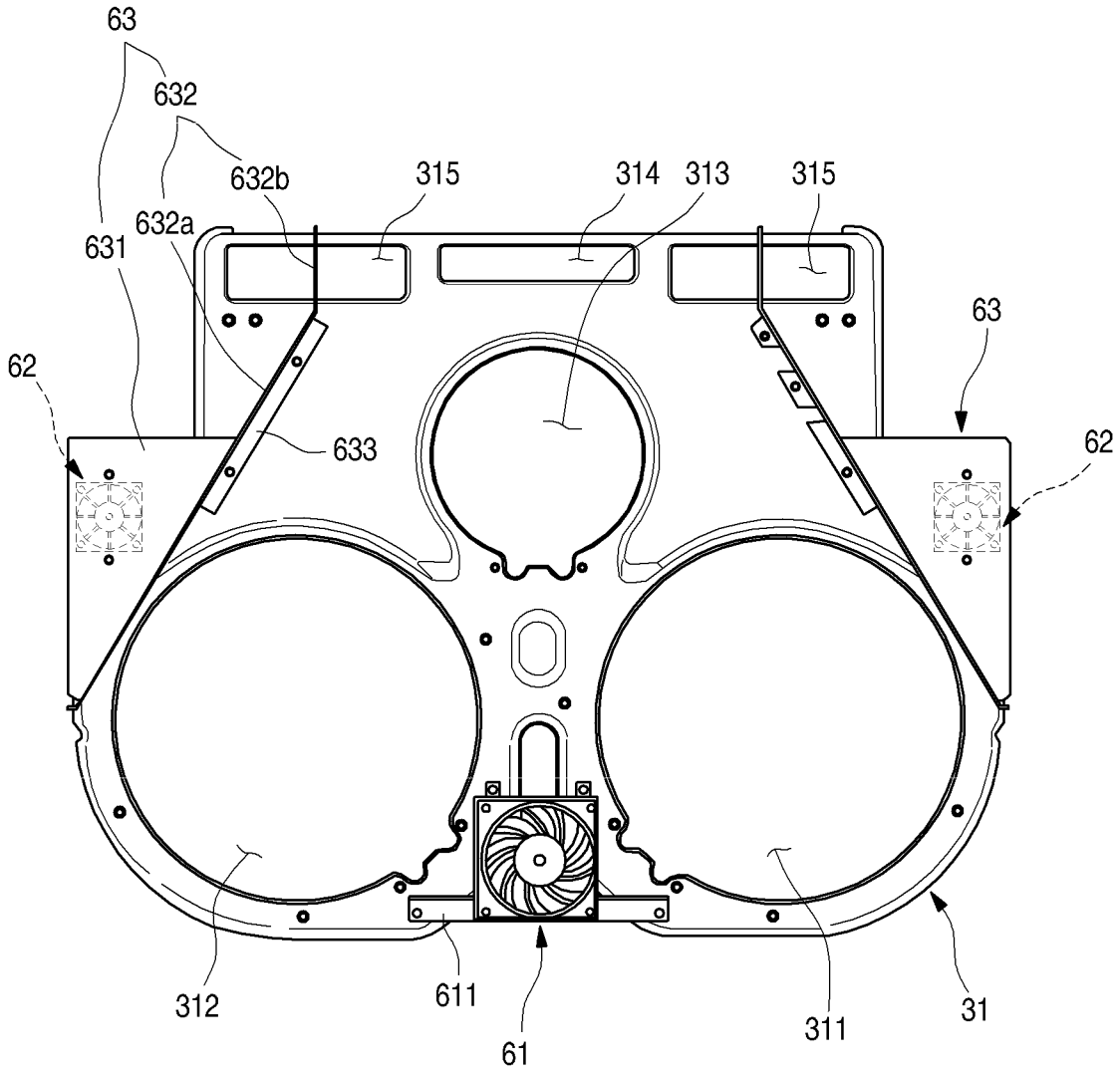
FIG. 10 is a diagram illustrating an example insulating case.

FIG. 9 illustrates an inside area of an example case. FIG. 10 illustrates an example insulating case.

As illustrated in the drawings, the main fan 61 and the sub-fan 62 for flowing air in the case 10 may be provided inside the case 10. Each of the main fan 61 and the sub-fan 62 is formed to have a box fan, and also formed to suction air outside the case 10 and then to discharge the suctioned air from an inside of the case 10. Of course, a structure of the fan may be employed according to a user's selection.

The main fan 61 and the sub-fan 62 enable external air to be introduced to the inside of the case 10 having a sealed structure, and simultaneously enable the air inside the case 10 to forcibly flow and thus to cool the inside of the case 10. And the air forcibly flowing in the case 10 may be discharged to an outside through the vent 21.

The air forcibly flows toward the operation unit 23 by driving of the main fan 61, and thus may cool a PCB 231 forming the operation unit 23. Through cooling of the PCB 231, the operation unit 23 and the operation part 201 of the plate 20 may be cooled so that the user does not feel discomfort due to heat generated when operating the operation part 201 of the plate 20.

And by the driving of the main fan 61, the air outside the case 10 is introduced, and forcibly flows radially centering on the case 10, and some of the air may flow along perimeters of the first burner 401 and the second burner 402, and thus heat from the first burner 401 and the second burner 402 does not stay at the inside of the case 10, but is discharged to the outside.

Therefore, the internal space of the case 10 may be cooled by the driving of the main fan 61, and may also protect electronic components in the case 10, i.e., the PCB 231 and sensors forming the operation unit 23.

The sub-fan 62 serves to cool the regulator 51 and the valve unit 52 provided at both of the left and right sides in the case 10, and is provided at each of the left and right sides of the case 10. And the sub-fan 62 is provided inside a space partitioned by a barrier 63, and by the barrier 63, a space in which the regulator 51 and the valve unit 52 are disposed may be partitioned from the space in which the burner 40 is provided. Therefore, by driving of the sub-fan 62, the air outside the case 10 may be introduced into the space partitioned by the barrier 63, and the regulator 51 and the valve unit 52 may be cooled separately from the space in which the burner 40 is disposed.

And a nozzle bracket 53 for protecting the nozzle 33 and the mixing tube 34 is further provided at the case 10. The nozzle bracket 53 is fixed to and installed at the bottom surface of the case 10 corresponding to a location at which the nozzle 33 is installed, and also bent to cover an outside of the nozzle 33.

Specifically, both of side ends of the nozzle bracket 53 are bent upward, and form a shielding portion 531, and the shielding portion 531 shields one side of each of the nozzle 33 and the mixing tube 34 including a space between the nozzle 33 and the mixing tube 34, and thus the air forcibly blown by rotation of the main fan 61 is prevented from being introduced into the space between the nozzle 33 and the mixing tube 34 and having an influence on supplying of the mixed gas.

As illustrated in the drawings, the regulator 51 which constantly adjusts a pressure of the gas supplied from an outside and the valve unit 52 which selectively supplies the gas supplied from the regulator 51 to the burner port 41 may be provided inside the case 10.

The regulator 51 and the valve unit 52 may be disposed at both corners of a rear end inside the case 10 in consideration of an arrangement and a structure of the burner unit 30 provided inside the case 10. The regulator 51 and the valve unit 52 are located in opposite directions to each other, and formed to be connected to each other by the gas pipe 35 such that the gas is supplied thereto.

And the sub-fan 62 is provided in front of each of the regulator 51 and the valve unit 52. The sub-fan 62 which serves to suction the air outside the case 10 into the case 10, then to blow the air toward the regulator 51 and the valve unit 52, and thus to cool the regulator 51 and the valve unit 52 may be disposed at the left and right sides of the case 10.

The barrier 63 is provided at the left and right sides inside the case 10. The barrier 63 provides an installing surface of the sub-fan 62, also enables the air blown by the sub-fan 62 to effectively cool the regulator 51 and the valve unit 52, and guides the air to be discharged toward the vent 21.

Both ends of the barrier 63 are fixed to and installed at a side surface and the rear surface of the case 10, respectively, and provide a space in which the regulator 51 or the valve unit 52 and the sub-fan 62 are disposed. A space partitioned by the barrier 63 is an outer area of the burner unit 30 which may form a space in the case 10 to be separated from the burner unit 30.

Therefore, the air forcibly flowing by an operation of the sub-fan 62 may effectively cool the space in the area partitioned by the barrier 63. That is, the external air suctioned by the sub-fan 62 is not mixed with the high-temperature air in the space in which the burner unit 30 is disposed, and thus may more effectively cool the regulator 51 and the valve unit 52.

The barrier 63 may be fixed to and installed at a lower surface of the insulating case 31, may connect between the insulating case 31 and the case 10, and may partition a space.

A fan seating portion 631 is formed in a right-angled triangular shape, and also formed so that one inclined end thereof is connected to a partitioning portion 632, and the other end is in close contact with the side surface of the case 10. Therefore, the barrier 63 may be maintained in a stably fixed state without vibration due to an air flow.

The partitioning portion 632 is formed to be vertically bent upward from the inclined end of the fan seating portion 631, and also formed to be fixed to a lower end of the insulating case 31 and to partition the internal space of the case 10.

And the partitioning portion 632 extends along the inclined end of the fan seating portion 631, may further extend outward, and thus may include a first partitioning portion 632*a* which partitions the case 10, and a second partitioning portion 632*b* which is bent from an end of the first partitioning portion 632*a* and partitions the side exhaust port 315.

The first partitioning portion 632*a* is formed to partition a space between the insulating case 31 and the case 10, and to guide the flow of the air blown by the sub-fan 62.

And the second partitioning portion 632*b* is bent from the end of the first partitioning portion 632*a*, passes through the side exhaust port 315, and extends to be in contact with the rear end of the case 10. Accordingly, by the second partitioning portion 632*b*, the side exhaust port 315 may be divided into both of left and right sides based on the second partitioning portion 632*b*, and the cooling air flowing along the first partitioning portion 632*a* may be independently discharged through the side exhaust port 315 partitioned by the second partitioning portion 632*b*.

In some implementations, a bent portion 633 which is bent outward may be further formed at an upper end of the first partitioning portion 632*a*. The bent portion 633 is in contact with the lower surface of the insulating case 31. And a fastening member S such as a screw and a bolt may be fastened to the bent portion 633 and the insulating case 31, and thus the barrier 63 may be fixed and installed.

Hereinafter, an operation of the gas cooker having such a configuration will be described.

Figure 11:
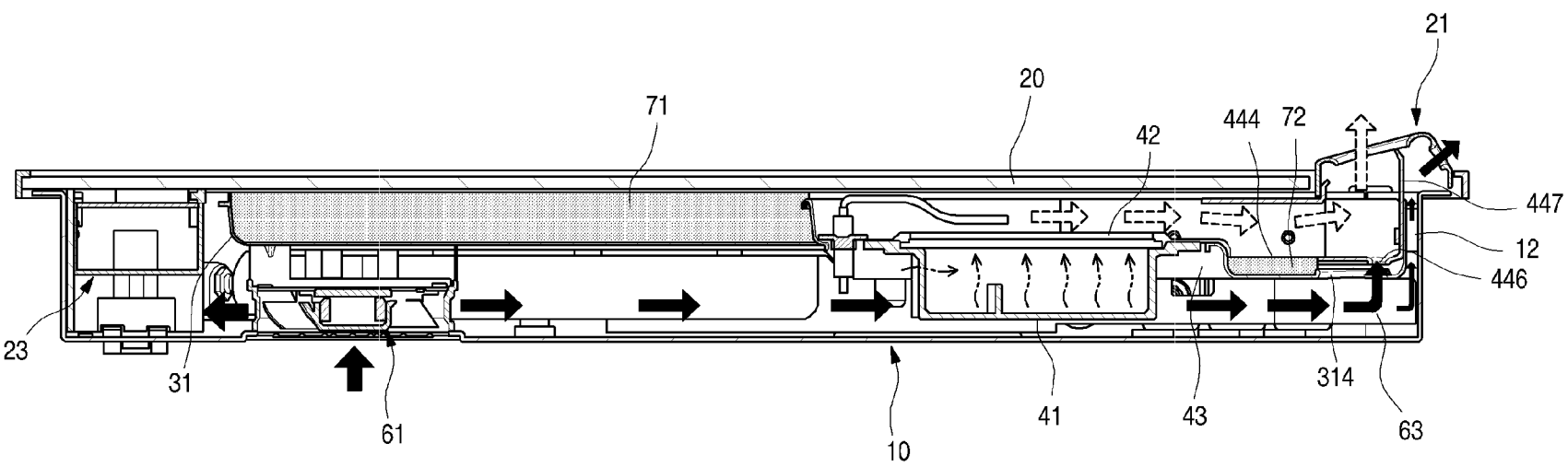
FIG. 11 is a diagram illustrating an example cross-sectional view of the example gas cooker of FIG. 1.
Figure 12:
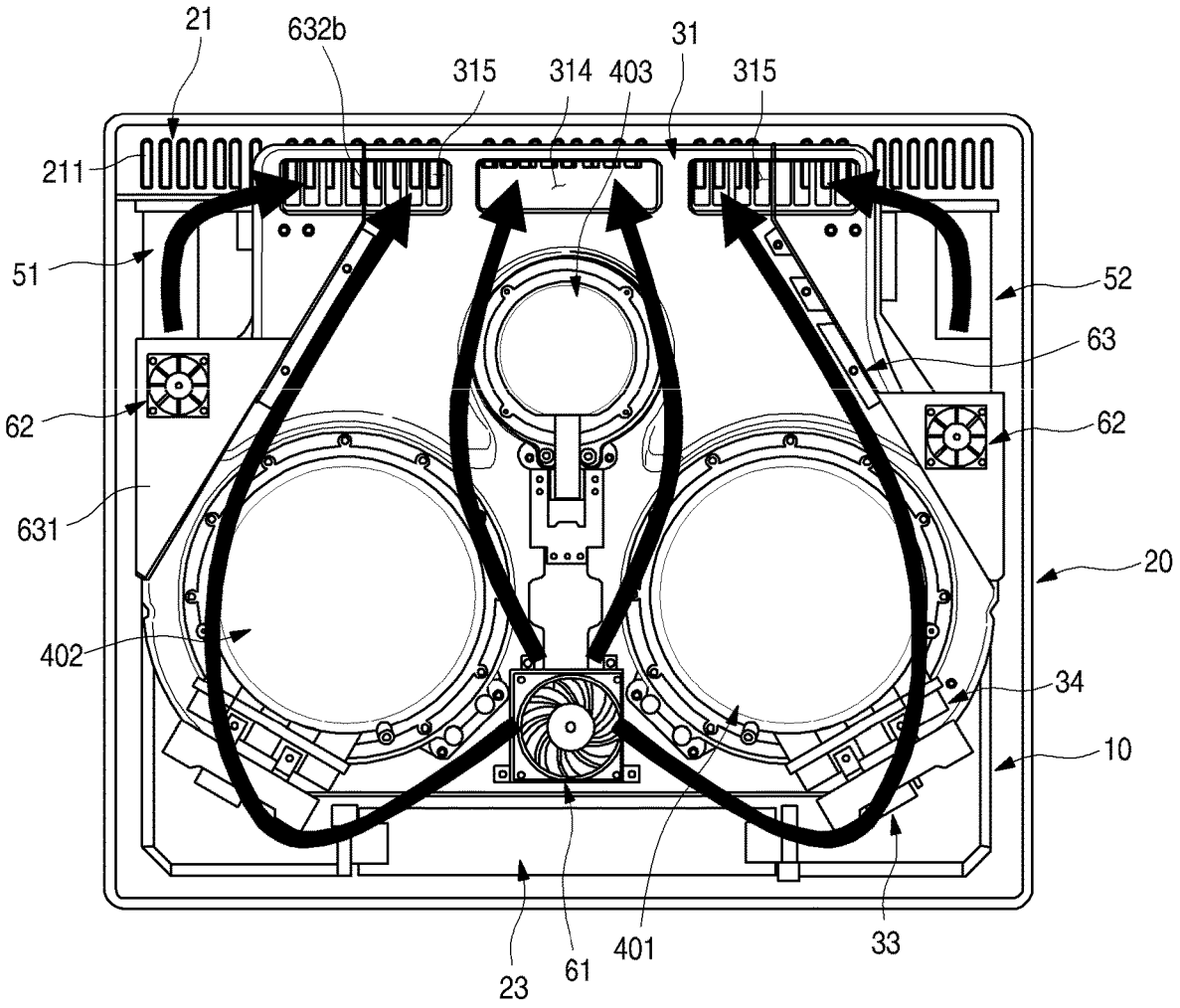
FIG. 12 is a diagram illustrating an example air flow inside an example gas cooker.

FIG. 11 illustrates an example cross-sectional view of the example gas cooker of FIG. 1. FIG. 12 illustrates an example air flow inside an example gas cooker.

As illustrated in the drawings, the user operates the operation part 201 exposed to the plate 20 to use the gas cooker 1. By operating the operation part 201, an operating signal may be input through the operation unit 23. Opening and closing of the valve unit 52 is determined by the operating signal, and thus the gas may be supplied to the desired burner 40.

When the gas is mixed with the air, and then supplied to the desired burner 40 in a mixed gas state, the mixed gas is ignited by the spark plug 32, and the combustion occurs at the heating element 42, and thus the heating element 42 may be heated. Due to heating of the heating element 42, the heating element 42 may radiate radiant waves to an outside, and may heat food or a container in which the food is put.

The user may control heating power of the burner 40 through the operation of the operation part 201, and may also visually check an ignition state and a heating state through the plate 20 because visible rays are included in the radiant wave generated upon the ignition and the heating of the burner 40.

The burned gas generated by the combustion in the burners 40 flows along the burned gas guide portion 444 formed by coupling the burner holder 44 and the burner cover 45. When the high-temperature burned gas reaches a lower end of the burned gas guide portion 444, the burned gas may be mixed with the cooling air introduced from a lower side through the cooling holes 446, and may be discharged to the outside through the vent 21.

In some implementations, upon the combustion in the burners 40, each of the plurality of burners 40 performs the combustion in an independent space partitioned by the upper insulator 71, and the burned gas is discharged through the burned gas guide portion 444. Accordingly, when two or more burners 40 are operated, the burned gas from one of the burners 40 may be prevented from being introduced to the other adjacent burner 40 and affecting the combustion. And the burned gas may flow along a space formed by the upper insulator 71, and may be discharged to the vent 21.

Also, the lower insulator 72 may be provided under the burned gas guide portion 444, may effectively insulate the burned gas guide portion 444 heated while the burned gas flows, and may also minimize heat transferred to an inside of the insulating case 31.

In some implementations, the main fan 61 and the sub-fan 62 are driven along with the ignition of the burner 40. By the driving of the main fan 61, the air in the case 10 may be suctioned toward the main fan 61. The suctioned air is discharged radially centering on the main fan 61.

Some of the air blown through the main fan 61 flows toward the PCB 231 of the operation unit 23, and thus the PCB 231 is continuously cooled to be normally operated.

And a portion of the air blown through the main fan 61 may pass between the first burner 401 and the second burner 402, and then may be discharged to the central exhaust port 314 along an outer side surface of the third burner 403.

And the remaining portion of the air blown through the main fan 61 flows along a space among the first burner 401, the second burner 402 and the side surface of the case 10, flows along the barrier 63 which partitions the internal space of the case 10, and then may be discharged to one side of the side exhaust port 315.

As described above, by rotation of the main fan 61, the air in the case 10 does not stay, but continuously cools the operation unit 23 and the front half portion of the plate 20 at which a cooling unit is located, and the air close to the first burner 401, the second burner 402 and the third burner 403 is discharged, and thus an internal temperature of the case 10 is prevented from being increased to a preset temperature or more.

And by the flow of the cooling air discharged through the central exhaust port 314 and the side exhaust port 315, the burned gas generated upon the combustion in the first burner 401, the second burner 402 and the third burner 403 may be mixed with the cooling air by a pressure difference, and may be discharged together. At this point, the high-temperature burned gas is mixed with the cooling air discharged from the inside of the case 10, and is in a low-temperature state, and then may be discharged to the outside through the vent holes 211 of the vent 21.

In some implementations, a protruding portion 12 which protrudes forward is formed at the rear surface of the case 10, and the rear end of the insulating case 31 and the protruding portion 12 are in contact with each other. Therefore, the rear end of the insulating case 31 and the rear surface of the case 10 may be spaced apart from each other, and may form passages separated from each other.

Therefore, the cooling air blown by the main fan 61 flows backward along the space between the insulating case 31 and the case 10. And at the rear end of the case 10, a portion of the cooling air may pass through the central exhaust port 314 and the side exhaust ports 315, may be mixed with the burned gas in the burner 40, and then may be discharged through the vent 21. And another portion of the cooling air may pass through the central exhaust port 314 and the side exhaust ports 315, may flow to the rear end of the case 10, may flow through a passage formed by the rear end of the insulating case 31 and the rear surface of the case 10, and then may be discharged through the vent 21.

Therefore, an outer side surface of the case 10 may be cooled by the cooling air, may protect the sink at which the gas cooker 1 is installed or other elements which form an exterior, and may prevent a damage thereof due to heat.

In some implementations, when the sub-fan 62 is driven, the external air outside the case 10 is introduced into the case 10, and the internal spaces formed at both sides of the case 10 and partitioned by the barrier 63 may be independently cooled.

In some implementations, the gas cooker may not be installed at the furniture such as the sink in a built-in method, but may be independently installed at a separate case.

Figure 13:
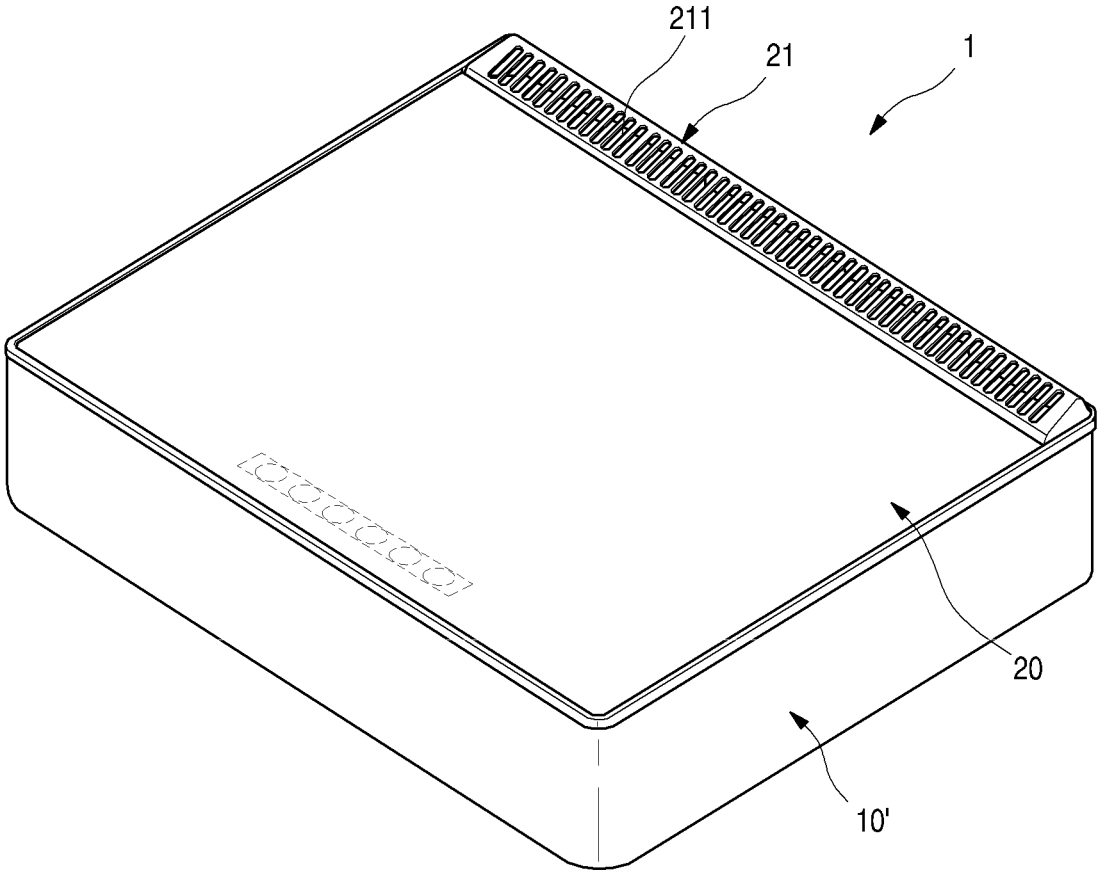
FIG. 13 is a diagram illustrating an example gas cooker.

FIG. 13 illustrates an example gas cooker.

As illustrated in the drawing, a gas cooker 1 includes the plate 20 and case 10. In some implementations, the plate 20 and the case 10 may have the same internal or external structure of the plate and the case described in the examples above.

In some implementations, the gas cooker 1 may be formed to be seated on an outer case 10' which forms an exterior while the plate 20 and the case 10 are assembled.

In some implementations, instead of the configuration of the case 10, the plate 20 may be directly installed at the outer case 10', and all of the elements including the burner unit 30 which are disposed in the case 10 may be installed inside the outer case 10'.

What is claimed is:

1. A gas cooker comprising:

a case defining an interior area, the case including an opening to the interior area;

a plate covering, fully or in part, the opening of the case;

a burner that is located in the interior area of the case, wherein the burner includes a heating element that is heated using gas;

a vent that is located at a rear end of the case and that is configured to discharge burned gas from the interior area of the case to an exterior of the case;

an insulating case that is coupled to the burner and accommodates the burner, the insulating case having an opened upper surface;

a first insulator inserted in a space defined between a perimeter of the insulating case and an outer side of the burner; and an operation unit that is in contact with a lower surface of the plate and that is located between a front end of the plate and an outer side of the first insulator, the operation unit being configured to control of the gas cooker based on touch operation on an area of the plate corresponding with the operation unit, wherein the plate is in contact with and presses the first insulator, and covers the opened upper surface of the insulating case and the burner.

2. The gas cooker of claim 1, wherein the first insulator extends along a border of the insulating case.

3. The gas cooker of claim 2, wherein an upper surface of the first insulator is in contact with the lower surface of the plate to cover the burner.

4. The gas cooker of claim 1, further comprising a plurality of burners located in the interior area of the case, wherein the first insulator covers areas between the plurality of burners.

5. The gas cooker of claim 4, wherein the first insulator comprises a sheet that is coupled to a circumferential portion of each burner.

6. The gas cooker of claim 4, wherein the first insulator includes:

a border portion coupled to a circumferential portion of the insulating case; and a partitioning portion that extends from a first area of the border portion to the vent, wherein the partitioning portion, in part or fully, covers areas between the plurality of burners.

7. The gas cooker of claim 6, wherein the partitioning portion includes one or more branches and is coupled to a circumferential portion of each burner.

8. The gas cooker of claim 1, further comprising:

a second insulator that is coupled between the burner and the insulating case and that is configured to reduce heat transfer from the burner to the insulating case.

9. The gas cooker of claim 8, wherein the insulating case includes a burner hole that holds the burner, and wherein the second insulator includes an open area corresponding to the burner hole and covers a surrounding area of the burner hole of the insulating case.

10. The gas cooker of claim 9, wherein a border line of the open area substantially matches to a border line of the burner hole.

11. The gas cooker of claim 10, wherein the burner includes:

a burner port configured to provide gas and hold the heating element, a spark plug configured to ignite fire using the provided gas, wherein the heating element is heated by the ignited fire;

a burner holder that (i) is configured to hold the spark plug, (ii) is coupled between the burner port and the plate, and (iii) includes a burned gas guide portion that flows burned gas to the vent; and a burner cover that is configured to cover the burned gas guide portion of the burner holder and that is configured to flow burned gas to the vent.

12. The gas cooker of claim 11, wherein the second insulator is coupled to the burned gas guide portion.

13. The gas cooker of claim 12, further comprising a plurality of burners located inside the insulating case, wherein the second insulator is coupled to each of the plurality of burners and configured to reduce heat transfer from each of the plurality of burners to the insulating case.

14. The gas cooker of claim 9, wherein the first insulator and the second insulator comprise compressible insulating material.

15. The gas cooker of claim 1, wherein the first insulator comprises elastically deformable material that is configured to be compressed.

16. The gas cooker of claim 1, further comprising:

a fan configured to provide air flow to the vent.

17. The gas cooker of claim 16, wherein the fan is configured to provide air flow to the insulating case.

18. The gas cooker of claim 1, wherein the plate is a metal plate.

19. The gas cooker of claim 1, wherein the plate is a ceramic plate.

20. The gas cooker of claim 1, wherein the first insulator comprises a protrusion extended toward a bottom surface of the case and inserted into the space defined between the perimeter of the insulating case and the outer side of the burner.

* * * * *